US010655474B2

(12) United States Patent
Krückels et al.

(10) Patent No.: US 10,655,474 B2
(45) Date of Patent: May 19, 2020

(54) TURBO-ENGINE COMPONENT HAVING OUTER WALL DISCHARGE OPENINGS

(71) Applicant: ANSALDO ENERGIA IP UK LIMITED, London (GB)

(72) Inventors: Joerg Krückels, Birmenstorf (CH); Herbert Brandl, Waldshut-Tiengen (DE)

(73) Assignee: General Electric Technology GmbH, Baden (CH)

( * ) Notice: Subject to any disclaimer, the term of this patent is extended or adjusted under 35 U.S.C. 154(b) by 543 days.

(21) Appl. No.: 15/223,102

(22) Filed: Jul. 29, 2016

(65) Prior Publication Data

US 2017/0030200 A1 Feb. 2, 2017

(30) Foreign Application Priority Data

Jul. 29, 2015 (EP) ..... 15178849

(51) Int. Cl.
*F01D 5/18* (2006.01)
*F01D 25/12* (2006.01)
*F01D 9/02* (2006.01)

(52) U.S. Cl.
CPC ..... *F01D 5/187* (2013.01); *F01D 5/186* (2013.01); *F01D 9/02* (2013.01); *F01D 25/12* (2013.01);
(Continued)

(58) Field of Classification Search
CPC ..... F01D 5/12; F01D 5/18; F01D 9/02; F01D 9/065; F01D 25/12; F01D 5/186;
(Continued)

(56) References Cited

U.S. PATENT DOCUMENTS 4,726,735 A 2/1988 Field et al.
5,392,515 A 2/1995 Auxier et al.
(Continued)

FOREIGN PATENT DOCUMENTS

AT 404 160 B 9/1998
CN 103 046 967 A 4/2013
(Continued)

OTHER PUBLICATIONS

European Search Report dated Jan. 29, 2016 for Application No. 15178849.4.
(Continued)

*Primary Examiner* — Moshe Wilensky
*Assistant Examiner* — Elton K Wong
(74) *Attorney, Agent, or Firm* — Armstrong Teasdale LLP

(57) ABSTRACT

Disclosed is a turbo-engine component comprising a wall, the wall comprising a hot gas side surface and a coolant side surface. At least one coolant discharge duct is provided in said wall and opening out onto the hot gas side surface at a coolant discharge opening. A coolant flow direction is defined from the interior of the coolant discharge duct towards the discharge opening, the coolant discharge duct further being delimited by a delimiting surface thereof provided inside the wall. The coolant discharge duct has a first cross sectional direction and a second cross sectional direction. The coolant discharge duct is a blind cavity and is closed towards the coolant side surface, and further a dimension of the coolant discharge duct measured in the first cross sectional direction decreases in the coolant flow direction.

14 Claims, 4 Drawing Sheets

(52) U.S. Cl.
CPC ..... *F05D 2220/32* (2013.01); *F05D 2240/81* (2013.01); *F05D 2260/202* (2013.01); *F05D 2260/204* (2013.01); *F05D 2260/231* (2013.01)

(58) Field of Classification Search
CPC ..... F01D 5/187; F05D 2260/20; F05D 2260/202; F05D 2260/204; F05D 2260/231
See application file for complete search history.

(56) References Cited

U.S. PATENT DOCUMENTS

| | | | | |
|---|---|---|---|---|
| 5,405,242 | A | 4/1995 | Auxier et al. | |
| 5,419,039 | A | 5/1995 | Auxier et al. | |
| 6,241,468 | B1 * | 6/2001 | Lock | F01D 5/186 415/115 |
| 7,766,618 | B1 | 8/2010 | Liang | |
| 8,594,191 | B2 | 11/2013 | Liang | |
| 8,851,848 | B1 * | 10/2014 | Liang | F01D 5/186 416/97 R |
| 2001/0016162 | A1 * | 8/2001 | Lutum | F01D 5/186 416/97 R |
| 2004/0253106 | A1 | 12/2004 | Self et al. | |
| 2006/0269410 | A1 * | 11/2006 | Downs | F01D 5/186 416/97 R |
| 2010/0008759 | A1 | 1/2010 | Johns et al. | |
| 2010/0129231 | A1 | 5/2010 | Brittingham et al. | |
| 2013/0004332 | A1 | 1/2013 | Schnieder et al. | |
| 2013/0280091 | A1 | 10/2013 | Propheter-Hinckley et al. | |
| 2014/0033736 | A1 | 2/2014 | Propheter-Hinckley et al. | |
| 2015/0016944 | A1 * | 1/2015 | Vandervaart | F01D 5/186 415/1 |
| 2016/0273364 | A1 * | 9/2016 | Bergholz | F23R 3/002 |
| 2017/0030198 | A1 * | 2/2017 | Kruckels | F01D 5/186 |

FOREIGN PATENT DOCUMENTS

| | | | |
|---|---|---|---|
| EP | 2 143 882 | A2 | 1/2010 |
| EP | 2 540 972 | A1 | 1/2013 |
| GB | 2 402 715 | A | 12/2004 |

OTHER PUBLICATIONS

European Search Report dated Jan. 29, 2016 for Application No. 15178850.2.

* cited by examiner

TURBO-ENGINE COMPONENT HAVING OUTER WALL DISCHARGE OPENINGS

TECHNICAL FIELD

The present disclosure relates to a turbo-engine component as set forth in claim 1.

BACKGROUND OF THE DISCLOSURE

It is known in the art to cool thermally loaded components in turbo-engines through so-called film cooling. Typical examples may be found in the expansion turbine of a gas turbine engine, where blades, vanes, platforms and other components in the hot gas path, and in particular in the hot gas path of the first expansion turbine stages, are exposed to a hot gas flow with a temperature exceeding the admissible temperature of the materials used for these components, the more when considering the significant mechanical stresses to which the components are exposed when operating the engine.

In applying film cooling, a layer of relatively cooler fluid is provided flowing along the surfaces of the components which are exposed to a hot working fluid flow.

To provide the film cooling fluid on the component surface, ducts are provided in walls of the component opening out on a hot gas exposed surface of hot gas exposed walls of the component. Said ducts are inclined with respect to a normal of the hot gas exposed surface, or hot gas side surface, of the wall. The ducts are in particular inclined into the main direction of the working fluid flowing along the component such as to discharge the film cooling fluid with a velocity component parallel to that of the working fluid, and tangential to the hot gas exposed surface, such that said layer of film cooling fluid is provided. The cooling effect becomes the more uniform the more uniform the distribution of cooling fluid on the hot gas exposed surface is. The distribution becomes more uniform as more holes are used. It is even further improved if slots instead of holes are provided. However, by nature the number of film coolant discharge ducts is limited. On the one hand, the coolant consumption needs to be limited, for instance, in order to avoid compromising negative impacts on the overall engine performance and efficiency. On the other hand, a large number of coolant discharge ducts, in particular if completely penetrating a wall of a component, may compromise structural integrity.

US 2001/0016162 proposes non-penetrating coolant discharge ducts which are in fluid communication with a coolant supply path provided inside the wall. The coolant supply path comprises a near wall cooling duct. In the near wall cooling duct, counterflow convective cooling is effected. Temperature distribution on the hot gas exposed surface of the turbo-engine component thus is rendered more uniform.

U.S. Pat. No. 7,766,618 proposes to provide the coolant discharge ducts as slots with a slot longitudinal direction extending across the main working fluid flow direction. Again, the coolant discharge ducts are shaped as blind cavities and are closed towards a coolant side of the wall. A multitude of coolant discharge ducts join at the hot gas exposed surface in order to provide a common coolant discharge slot with a longitudinal axis oriented across the flow direction of a main working fluid flow. Thus, it is expected to achieve a coolant flow dispersed over the hot gas exposed surface across the main working fluid flow direction. However, as the coolant discharge ducts join immediately adjacent the hot gas exposed surface, still a largely non-uniform coolant distribution on the hot gas side surface is supposed.

LINEOUT OF THE SUBJECT MATTER OF THE PRESENT DISCLOSURE

It is an object of the present disclosure to provide a turbo-engine component exhibiting film cooling features. In one aspect, improved cooling of the component is to be achieved. In another aspect, effective use of the coolant is to be provided for. In still another aspect, a more uniform cooling of and in turn temperature distribution in a hot gas exposed wall of a turbo-engine component shall be achieved. In yet another aspect, the distribution of coolant on a hot gas exposed surface and across a main working fluid flow direction shall be improved. In a further aspect, the film cooling features shall be provided such as to maintain sufficient material such as not to compromise the structural integrity of the component.

Further effects and advantages of the disclosed subject matter, whether explicitly mentioned or not, will become apparent in view of the disclosure provided below.

This is achieved by the subject matter described in claim 1 and set forth herein below.

Accordingly, disclosed is a turbo-engine component comprising a wall, the wall comprising a hot gas side surface and a coolant side surface, wherein at least one coolant discharge duct is provided in said wall and opening out onto the hot gas side surface at a coolant discharge opening. A coolant flow direction of the coolant discharge duct is defined from the interior of the coolant discharge duct towards the discharge opening. The coolant discharge duct is delimited by a delimiting surface thereof, provided as an inner surface of the wall. The coolant discharge duct has a first cross sectional direction and a second cross sectional direction. In particular, the first and second cross sectional directions may be perpendicular to each other. It is further understood that the cross sectional directions are oriented across and in particular at least essentially perpendicular to the coolant flow direction as defined above. It will be appreciated, that further in particular said cross sectional directions may span up a flow cross section of the coolant discharge duct. The coolant discharge duct is a blind cavity and is closed towards the coolant side surface. A dimension of the coolant discharge duct measured across the coolant discharge duct and in the first cross sectional direction decreases in the coolant flow direction. In other words, in the coolant flow direction the coolant discharge duct tapers when considering the dimension of the coolant discharge duct measured across the coolant discharge duct in the first cross sectional direction. Said contouring of the coolant discharge duct flow cross section for the coolant to be discharged provides for the capability to influence the flow field of the discharged coolant. Such, for instance, a more homogenous distribution of the coolant discharge flow on a hot gas exposed surface of the component may be achieved.

In a further embodiment, a dimension of the coolant discharge duct measured across the coolant discharge duct and in the first cross sectional direction decreases in the coolant flow direction, and a dimension of the coolant discharge duct measured across the coolant discharge duct and in the second cross sectional direction increases in the coolant flow direction. In other words, in the coolant flow direction the coolant discharge duct tapers when considering the dimension of the coolant discharge duct measured across the coolant discharge duct in the first cross sectional direction, and widens when considering the dimension of the coolant discharge duct measured across the coolant discharge duct and in the second cross sectional direction.

In providing said three-dimensional contouring of the coolant discharge duct, the flow field of the coolant discharged therefrom onto the hot gas side surface may be adjusted. The contouring of the coolant discharge duct may be chosen such that the flow is evenly distributed over the wider dimension of the duct at the discharge location on the hot gas side surface. In particular, the contouring may be chosen such that an even velocity distribution of the discharged coolant upon exit from the coolant discharge duct is achieved along the second cross sectional direction. The tapering geometry of the coolant discharge duct in the first direction in turn serves to adjust the mean velocity of the coolant emanating from the coolant discharge duct while it widens in the second direction. Said cooperating tapering of the coolant discharge duct in one cross sectional direction and widening in another cross sectional direction may serve to adjust the flow cross section accordingly. Providing the coolant supply duct as a blind cavity, not completely penetrating the wall, may serve to improve mechanical strength and preserve structural integrity of the component and in turn to enhance service lifetime. Due to the fact that the coolant discharge channel is non-penetrating, which is in the frame of this document to be understood as not entirely penetrating the wall from the hot gas side surface to the coolant side surface, sufficient material is preserved even with comparatively large cross section coolant discharge ducts. Moreover, by virtue of shaping the coolant discharge duct such that its dimension increases along one cross sectional direction while decreasing in another cross sectional direction, the reduction of the material strength may not be locally concentrated, which would result in peak stresses, but may be distributed over a larger volume.

Further, the coolant discharge duct may be shaped such that the flow cross section provided by the coolant discharge duct for the flow of the coolant to be discharged decreases in the coolant flow direction. In other words, in the coolant flow direction the coolant discharge duct cross sectional flow area for the coolant flow tapers. The coolant flow is accelerated in the coolant discharge duct. Flow separation of the coolant discharge flow from the contoured delimiting surfaces of the coolant discharge duct may thus be effectively avoided.

In particular embodiments of the turbo-engine component, the first cross sectional direction extends in a main working fluid flow direction on the hot gas side of the wall. It will be appreciated to this extent that the component is intended for a specific use, and thus the main working fluid flow direction is a well-defined orientation of the component, and/or a hot gas exposed wall thereof, respectively. The component may for instance be, but not limited to, a blade, vane, airfoil, platform, heat shield and the like, having an aerodynamic shape and/or fixation means which relate to the intended main working fluid flow direction in a unique manner.

In another aspect, the coolant discharge opening is a slot with a longitudinal extent of the slot being provided along the second cross sectional direction. It should be noted, that the slot may be straight or curved. In this respect, the coolant is discharged through the slot, in the form of a thin layer of coolant emanating from the slot and extending along the second cross sectional direction. In particular, in embodiments where the second cross sectional direction is oriented across a main working fluid flow direction, or, the first cross sectional direction is oriented along a main working fluid flow direction, said layer of emanating coolant is provided across the main working fluid flow direction and thus results in a more homogeneous coolant layer across the main working fluid flow direction.

The coolant discharge duct may be slanted or, in another aspect, may be inclined with respect to a normal of the hot gas side surface at a first angle. The coolant flow direction accordingly has a directional component oriented tangentially to the hot gas side surface of the wall, supporting film cooling as lined out above. In another aspect, the coolant discharged from the coolant discharge duct accordingly has a velocity component oriented parallel to the hot gas side surface of the wall. A direction of the coolant discharge duct may be defined by an axis thereof. In another point of view, an orientation of delimiting surfaces of the coolant discharge duct may be said to define said orientation and in turn said inclination. In still another point of view, a mean orientation of the delimiting surfaces of the coolant discharge duct may be said to define said orientation and in turn said inclination. A lateral delimiting surface of the coolant discharge duct accordingly comprises a first surface section disposed towards the hot gas side surface of the wall and a second surface section disposed towards the coolant side surface of the wall.

The inclination may in certain embodiments be provided in a plane defined by the first cross sectional direction and said normal. It may then be said that said first angle is located in a plane defined by the first cross sectional direction and the normal. In particular in connection with embodiments wherein the coolant discharge opening is a slot with the long side of the slot being oriented along the second cross sectional direction of the coolant discharge duct, a coolant layer is discharged with a plain surface of the layer being slanted towards the hot gas side surface, further supporting film cooling.

In further embodiments, said inclination may be directed downstream a main working fluid flow direction of the component along the coolant flow direction. It may then be said that said first angle is located in a plane defined by the main working fluid flow direction and the normal. It may in this case, in another point of view, be said that an orientation of the coolant discharge duct along or tangential to the hot gas side surface, or, the direction into which a coolant discharge duct is slanted, defines the main working fluid flow direction. The coolant discharged from the coolant discharge duct in this embodiment is slanted towards the downstream direction of the main working fluid flow direction. That is, the discharged coolant flow is oriented at least with a velocity component thereof in parallel with the main working fluid flow direction. In particular in embodiments where the coolant discharge opening is provided as a slot, with the long side of the slot oriented across the main working fluid flow direction, a layer of coolant is effectively dispersed across the main working fluid flow direction. It may in this case be said that the first delimiting surface section of the coolant discharge duct is disposed towards the hot gas side surface of the wall, and upstream with respect to the main working fluid flow direction, while a second delimiting surface section is disposed towards the coolant side surface of the wall and downstream with respect to the main working fluid flow direction.

In still further embodiments of the turbo-engine component the coolant discharge duct is delimited by a delimiting surface, the delimiting surface comprising a first surface section disposed towards the hot gas side surface and a second surface section disposed towards the coolant side surface, wherein at least one of the first and second surface sections comprises a flat surface section. Said embodiment supports and facilitates providing a slot-shaped coolant discharge opening.

In still further embodiments of the turbo-engine component as herein described, the component further comprises a coolant supply path provided in the wall and in fluid communication with the coolant discharge duct, wherein the coolant supply path joins the coolant discharge duct at a lateral delimiting surface of the coolant discharge duct and at a nonzero angle. Through said coolant supply path, coolant can be supplied to the coolant discharge duct, while providing the coolant supply duct closed towards the coolant side of the wall. In particular, coolant flowing out from the coolant supply path and into the coolant discharge duct may be discharged from the coolant supply path and into the coolant discharge duct such as to effect impingement cooling of an opposed delimiting surface section. In certain embodiments, the nonzero angle may be at least approximately 90 degrees, and may be in particular 70 degrees or larger, related to the surface at which the coolant supply path joins the coolant discharge duct, or related to the coolant discharge direction. The coolant supply path may join the coolant discharge duct through an opening provided in a lateral delimiting surface section of the coolant discharge duct disposed on a downstream side with respect to a main working fluid flow direction. This supports impingement cooling of a surface section of the coolant discharge duct disposed upstream with respect to the main working fluid flow direction. More specifically, the coolant supply path may join the coolant discharge duct at a certain distance from the blind end, or upstream end with respect to the coolant discharge flow direction of the coolant discharge duct. This enables the impingement cooling free jet emanating from the coolant supply path and into the coolant discharge duct to more uniformly disseminate over a surface on which it impinges. A coolant supply opening, or a nozzle, through which the coolant supply path joins the coolant discharge duct has a size in the coolant flow direction, or, in specific embodiments, a diameter. A lower or upstream edge of said coolant supply opening is spaced from a blind or upstream end of the coolant discharge duct by a distance, which is in certain embodiments larger than or equal to 50% of said coolant supply opening size or diameter, and in still further embodiments larger than or equal to 70% of said coolant supply opening size or diameter. In another aspect, a center of the coolant supply opening, when seen along the coolant flow direction, is spaced apart from the blind or upstream end of the coolant discharge duct by a distance which is larger than or equal to said coolant supply opening size or diameter, and is more particularly larger than or equal to 1.2 times said coolant supply opening size or diameter. Impingement cooling effectiveness is improved.

The coolant supply path may further join the coolant discharge duct through an opening provided in a lateral delimiting surface section thereof disposed towards the coolant side surface of the wall. Thus, impingement cooling of a lateral delimiting surface of the coolant discharge duct disposed towards the hot gas side surface of the wall is supported. Adjacent said hot gas side disposed surface section of the surface delimiting the coolant discharge duct, only a small wall thickness may be present between the delimiting surface of the coolant discharge duct and the hot gas side surface. Moreover, said wall section may not fully benefit from the film cooling layer emanating from the coolant discharge duct, if it is located at an upstream location with respect to the main working fluid flow. This wall section may thus be particularly vulnerable to heat intake from the working fluid flow. A remedy for this situation is provided according to the present disclosure in providing the junction of the coolant supply path and the coolant discharge duct at a lateral delimiting surface of the coolant discharge duct which is disposed towards the coolant side surface, thus discharging the coolant supply flow from the coolant supply path, and directing the coolant supply flow onto said surface section of the coolant discharge duct which is disposed towards the hot gas side surface of the wall. Thus impingement cooling of the respective wall section is affected.

In order to further support impingement cooling of a lateral surface section of the coolant discharge duct disposed opposite the junction of the coolant supply path and the coolant discharge duct, a means for providing a free jet emanating from the coolant supply path and into the coolant discharge duct may be provided. Said means may in particular be provided as a flow accelerating section of the coolant supply path provided at or adjacent to the junction of the coolant supply path and the coolant discharge duct. In accelerating the coolant supply flow prior to or upon entry into the coolant discharge duct, a high impulse jet is generated across the coolant discharge duct which impinges on a opposed delimiting surface section of the coolant discharge duct and effectively effects impingement cooling. The flow accelerating section may be shaped as a nozzle provided at the junction of the coolant supply path and the coolant discharge duct. The coolant supply path may be provided as a duct having a first flow cross section which tapers to a throat having a smaller cross section at or adjacent to the junction of the coolant supply path and the coolant discharge duct. In providing a flow accelerating section of the coolant supply path, and in particular providing an accelerating section which effects a continuous flow acceleration, such as for instance a nozzle, more defined and unidirectional free jet flows are achieved, when compared to simple orifices as would be provided by simple metering holes. Impingement cooling efficiency and effectiveness are enhanced and become more predictable.

In this respect, the junction of the coolant supply path and the coolant supply duct may be provided such as to provide a free jet emanating from the free jet generating means in a jet direction having at least one of a velocity component oriented from the coolant side surface of the wall and towards the hot gas side surface of the wall, and/or oriented upstream the main working fluid flow direction.

In particular, the coolant supply path may be in fluid communication with a coolant supply volume provided adjacent the coolant side surface of the wall such as to provide a coolant flow from said supply volume to the coolant discharge duct.

In still further embodiments of the turbo-engine component according to the present disclosure, the coolant supply path comprises a near wall cooling duct running inside the wall along a lengthwise extent of the wall. A lengthwise extent of the wall is in this respect will be understood as extending between and along, or essentially aligned with, the hot gas side surface of the wall and the coolant side surface of the wall. In certain aspects it may be understood as parallel to at least one of the hot gas side surface and the coolant side surface. In specific aspects it may be understood as extending at least essentially parallel to the main working fluid flow direction. The near wall cooling duct extends from a first end thereof to a second end thereof, wherein a means for providing a free jet, as in particular embodiments a nozzle, or, more generally, a flow acceleration means, may be disposed adjacent the second end of the near wall cooling duct.

In certain embodiments, the first end of the near wall cooling duct is disposed downstream of the second end of the near wall cooling duct with respect to the main working fluid flow direction. By virtue of this specific embodiment convective counterflow near wall cooling is effected before the coolant supply flow is discharged from the coolant supply path into the coolant discharge duct.

The near wall cooling duct, in further embodiments, runs at least essentially in parallel to the hot gas side surface.

The internal surfaces of the near wall cooling duct may be shaped such as to improve heat transfer between the surfaces of the near wall cooling duct and the coolant supply flow therethrough, and/or may be equipped with elements enhancing heat transfer. Any means known to the skilled person which intensify heat transfer between the surfaces delimiting the near wall cooling duct and the coolant flow therethrough may be applied, such as, but not limited to, posts connecting opposed surfaces, the delimiting surfaces of the near wall cooling duct may be undulating, and so forth. In specific embodiments, turbulence generating elements are provided within the near wall cooling duct and on a delimiting surface thereof.

In still further embodiments of the turbo-engine component according to the present disclosure, a coolant inflow duct is provided extending between the coolant side surface of the wall and the near wall cooling duct, and joins the near wall cooling duct at a sidewall thereof, wherein the junction is provided at or adjacent the first end of the near wall cooling duct, and is in particular provided on a side of the near wall cooling duct disposed towards the coolant side surface of the wall. It is further conceivable that a free jet generating means, similar to that described above at or adjacent to the junction of the coolant supply path and the coolant discharge duct, is disposed adjacent to or at the junction of the coolant inflow duct and the near wall cooling duct. In particular in embodiments, where the coolant inflow duct joins the near wall cooling duct at a delimiting surface thereof disposed towards the coolant side, the free jet impinges on an opposed delimiting surface section of the near wall cooling duct which is disposed towards the hot gas side surface. As will be appreciated, a wall section of the component at this surface section may be disposed comparatively far downstream the coolant discharge location on the hot gas side surface, again related to the main working fluid flow direction, and may thus be subject to comparatively high thermal loading. By virtue of the impinging free jet from the coolant inflow duct, effective impingement cooling of said wall section is effected.

As is readily apparent to the skilled person, an extent of the near wall cooling duct across and along the main working fluid flow direction may be chosen larger than a cross sectional extent in a direction between the coolant side surface and the hot gas side surface.

The turbo-engine component as herein disclosed may comprise two or more coolant discharge ducts of the kind disclosed above provided in a wall of the turbo-engine component, wherein said at least two coolant discharge ducts are each provided with a coolant discharge opening provided towards the hot gas side surface of the wall. Each of said coolant discharge openings has a cross section, wherein said cross section exhibits a first extent in a first direction being smaller than a second extent in a second direction. The coolant discharge openings are arranged such that short edges of two neighboring coolant discharge openings are disposed adjacent each other. A distance between adjacent short edges of neighboring coolant discharge openings may be substantially smaller than the—longer—extent of each coolant discharge opening in the second direction. Said distance between two adjacent short edges may be 50% or less, 40% or less, 30% or less, 20% or less, and in particular 10% or less of the extent of each of the adjacent coolant discharge openings in the second direction. The respective coolant discharge ducts may be inclined in the first direction of the coolant discharge openings. Further, the coolant discharge ducts may be slanted downstream the main working fluid flow direction.

The coolant discharge openings may be aligned with each other along the second direction. That is, in other words, a row of, in particular slot-shaped, coolant discharge openings are provided on the hot gas side surface of the wall, with the long extents of the coolant discharge openings being at least substantially aligned with each other. In other embodiments, however, the coolant discharge openings may be arranged such as to form a zig-zag, or in an undulating manner. As will be appreciated, by virtue of said arrangement of coolant discharge openings, a multitude of coolant layers or sheets are discharged from on the hot gas side surface, wherein each layer or sheet extends across the first cross sectional direction. In particular embodiments, the coolant discharge ducts are aligned with the first cross sectional direction along the main working fluid flow direction, and the coolant discharge ducts are inclined such that the coolant is discharged with a velocity component directed downstream the main working fluid flow direction. The coolant is thus effectively dispersed across the main working fluid flow direction and downstream the coolant discharge openings on the hot gas side surface of the wall, thus providing for superior film cooling effectiveness and efficiency.

A multitude of arrangements of adjacent coolant discharge openings, each being in particular in flow communication with a coolant discharge duct of the manner described above, may be provided and staggered in the first direction and/or in the main working fluid flow direction.

In still further embodiments of the turbo-engine component, at least two coolant discharge openings adjoin each other at short edges thereof such as to provide a common coolant discharge opening of said at least two coolant discharge ducts. By virtue of this embodiment, the homogenous distribution of the discharged coolant on the hot gas side surface may be further supported and improved.

As will be appreciated, certain embodiments of the disclosed subject matter may require complex duct geometries to be provided inside the wall of the component. Said ducts may not or may only expensively be manufactured by chip removing methods. The component may be thus in particular be obtained by high precision casting. In further embodiments, the component may be obtained by additive production methods, such as, but not limited to, selective laser melting or selective electron beam melting.

Further a gas turbine engine is disclosed comprising a turbo-engine component as described above.

It is understood that the features and embodiments disclosed above may be combined with each other. It will further be appreciated that further embodiments are conceivable within the scope of the present disclosure and the claimed subject matter which are obvious and apparent to the skilled person.

BRIEF DESCRIPTION OF THE DRAWINGS

The subject matter of the present disclosure is now to be explained in more detail by means of selected exemplary embodiments shown in the accompanying drawings. The figures show FIG. 1 a sectional view of a wall of a turbo-engine component comprising cooling features as described above, exposing a longitudinal section of a coolant discharge duct.

It is understood that the drawings are highly schematic, and details not required for instruction purposes may have been omitted for the ease of understanding and depiction. It is further understood that the drawings show only selected, illustrative embodiments, and embodiments not shown may still be well within the scope of the herein disclosed and/or claimed subject matter.

EXEMPLARY MODES OF CARRYING OUT THE TEACHING OF THE PRESENT DISCLOSURE

Figure 1:
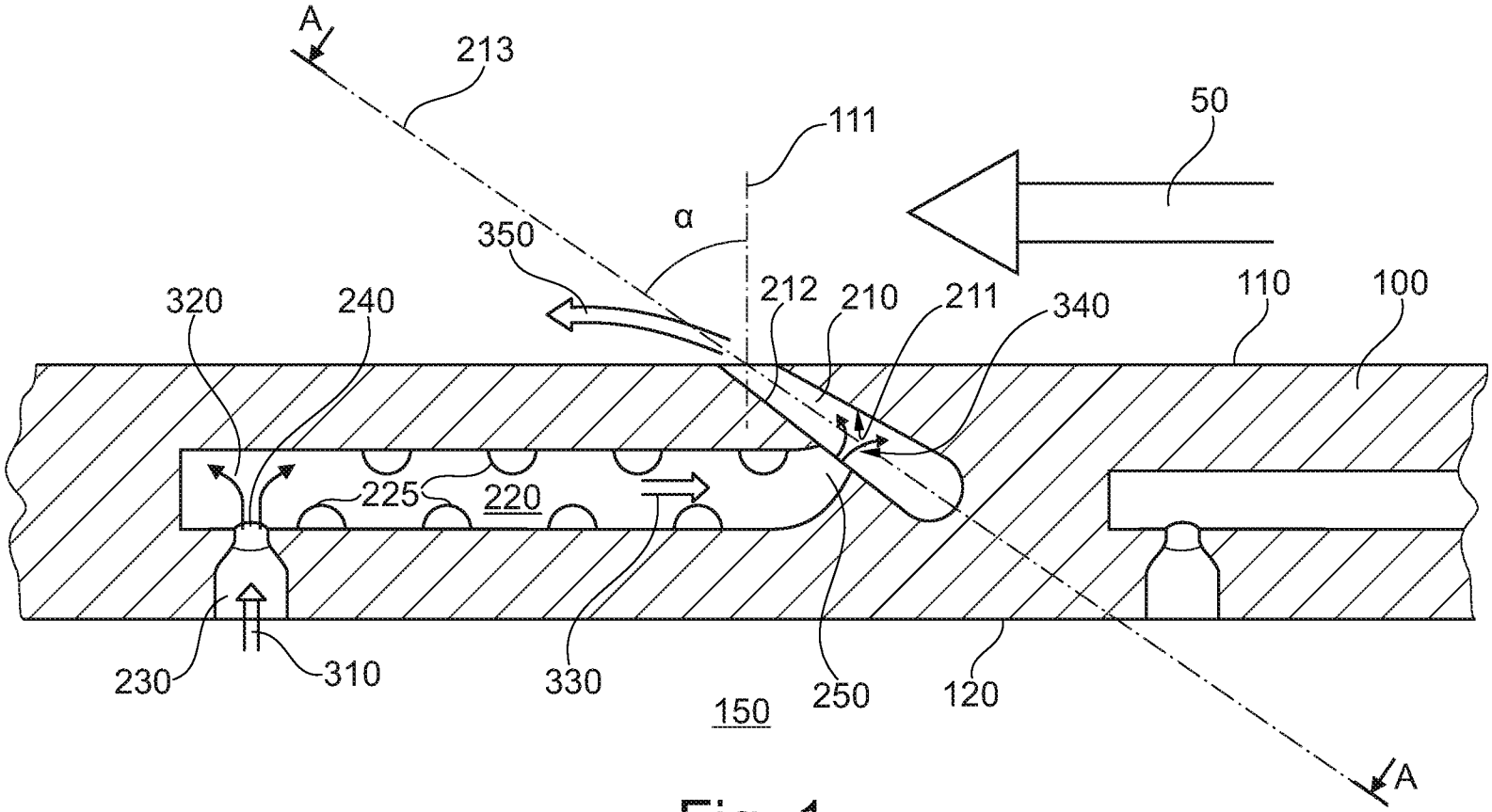

FIG. 1 shows an embodiment of a wall 100 of a turbo-engine component. The wall 100 comprises a hot gas side surface 110 and a coolant side surface 120. The hot gas side surface 110 is intended, when the component is installed in a turbo-engine, and the turbo-engine is operated, to be exposed to a working fluid flow 50. The component is in particular intended to be installed in the turbo-engine such that the working fluid flow flows along the hot gas side surface 110 of the component wall 100 in a main working fluid flow direction indicated by the arrow at 50, into a main working fluid flow downstream direction. It is to this extent possible to define an upstream and a downstream direction of the component, or the wall 100, respectively, related to the main working fluid flow direction. The working fluid flow 50 may be present at elevated temperatures, for instance in an expansion turbine of a gas turbine engine. In particular, components installed in the first stages of such an expansion turbine thus require cooling. A coolant discharge duct 210 is provided in the wall 100. Coolant discharge duct 210 is delimited by a delimiting surface provided inside the wall 100. An axis 213 of the coolant discharge duct is inclined with respect to a normal 111 of the hot gas side surface 110 at an angle $\alpha$, and is slanted towards the downstream direction of the working fluid main flow when considering an orientation of the coolant discharge duct 210 from inside the wall to a discharge opening provided on the hot gas side surface. In another aspect, a first section 211 of the delimiting surface and a second section 212 of the delimiting surface are inclined with respect to the normal, and slanted towards a downstream orientation of the main working fluid flow direction. It will be appreciated, that wall 100 may be curved, and consequently the hot gas side surface 110 may be curved. It will be readily understood by the skilled person, that in this instance a local normal at a location where the fluid discharge duct opens out onto the hot gas side surface, that is, a discharge location, will be applied for the definition of said normal, or said inclination, respectively. A coolant discharge flow 350 is discharged from coolant discharge duct 210 through a coolant discharge opening provided on the hot gas side surface and is provided as a coolant layer flowing over the hot gas side surface 110, thus on the one hand removing heat from the component, or the component wall 100, respectively, and furthermore separating the hot gas side surface of the wall from the main working fluid flow 50. Due to the inclination of the coolant discharge duct 210, first surface section 211 is disposed towards the hot gas side surface, and second surface section 212 is disposed towards the coolant side surface of the wall 100, or the component, respectively. In another aspect it may be said that the first section 211 of the delimiting surface is disposed upstream while the second section 212 of the delimiting surface is disposed downstream, in each case related to the main working fluid flow direction. The coolant discharge duct is provided as a blind cavity inside the wall 100, not completely penetrating the wall from the hot gas side surface to the coolant side surface. It is closed towards the coolant side surface 120 of the wall. In order to provide a coolant to the coolant discharge duct, a coolant supply path is provided, comprising a coolant inflow duct 230 and a near wall cooling duct 220. A multitude of coolant inflow ducts may typically be provided in fluid communication with a near wall cooling duct, and in a row extending across the width of the near wall cooling duct. Near wall cooling duct 220 is disposed inside the wall 100 and runs along a lengthwise extent of the wall as defined by the main working fluid flow direction in this particular embodiment. In particular, the near wall cooling duct may be arranged to run at least essentially parallel to the hot gas side surface 110 of the wall 100. The coolant inflow duct extends from the coolant side surface 120 of the wall. It joins the near wall cooling duct at a lateral surface of the near wall cooling duct, and near a first end of the near wall cooling duct. Said first end, in the present embodiment, is a downstream end of the near wall cooling duct with respect to the main working fluid flow direction. It is an upstream end of the near wall cooling duct with respect to the near wall coolant flow direction. The near wall cooling duct 220 extends within the wall from the first end to a second end, wherein the second end is disposed upstream the first end with respect to the main working fluid flow direction. A nozzle 250 is provided adjacent the second end of the near wall cooling duct, and joins the coolant discharge duct 210 at a lateral surface thereof, namely at second or downstream surface section 212 which is disposed towards the coolant side 120 of the wall. The coolant supply path joins the coolant discharge duct at a nonzero angle, and in this particular embodiment at least essentially at a right angle. Coolant inflow duct 230 opens out onto the coolant side surface 120. Thus, the coolant supply path is in fluid communication with a coolant supply volume 150 provided adjacent the coolant side surface 120 of the wall 100. As indicated at 310, the coolant supply flow flows from the coolant supply volume 150 and into coolant inflow duct 230. At a junction with the near wall cooling duct 220, a nozzle 240 is provided. Said nozzle is not essential for the teaching of the present disclosure, but is a well-conceivable embodiment. Through nozzle 240, a coolant free jet 320 enters near wall cooling duct 220 and effects impingement cooling of a part of a delimiting surface of the near wall cooling duct which is disposed towards the hot gas side surface of the wall and is thus exposed to heat intake from the working fluid flow 50, although said heat intake is reduced by coolant flow 350 flowing over the hot gas side surface. The coolant supply flow further flows through near wall cooling duct 220 as near wall cooling flow 330 in a direction oriented from the first end of the near wall cooling duct to the second end of the near wall cooling duct. The flow direction of near wall cooling flow 330 is oriented against the main working fluid flow direction 50. Thus, counterflow cooling of the wall is effected. In order to intensify heat exchange between near wall coolant flow 330 and the delimiting surface of near wall cooling duct 220, protruding elements 225 are arranged on said delimiting surface, and act as turbulators. In addition, the turbulators enlarge the surface area which participates in heat transfer. Other means known to the skilled person which intensify heat transfer between the surfaces delimiting the near wall cooling duct and the coolant flow therethrough may be present instead of, or in addition to, the protrusions, such as, but not limited to, posts connecting opposed surfaces, the delimiting surfaces of the near wall cooling duct may be undulating, and so forth. Near wall coolant flow 330 then is discharged from the coolant supply path through nozzle 250 as a free jet 340 and into coolant discharge duct 210. Free jet 340 impinges on the first surface section 211 of a delimiting surface which delimits the coolant discharge duct and effects impingement cooling of said surface, and accordingly a related section of the wall 100. The coolant discharged into coolant discharge duct 210 through free jet 340 is subsequently discharged as coolant discharge flow 350 at the hot gas side surface 110 of the wall 100, and forms a film cooling flow as described above. In providing nozzles 250 and 240, and thus a continuous acceleration of the flow therethrough to form the free jets, more defined and unidirectional free jet flows are achieved, when compared to simple orifices, thus enhancing impingement cooling efficiency. It is noted that nozzle 250 joins the coolant discharge duct 210 at a certain distance from the blind end, or upstream end with respect to the coolant discharge flow direction, of the coolant discharge duct 210. This will be lined out in more detail in connection with FIG. 2. This enables free jet 340 to more uniformly disseminate over first section 211 of the delimiting surface of the coolant discharge duct. Likewise, and for the same reason, it is noted that coolant inflow duct 230, or nozzle 240, respectively joins the near wall cooling duct 220 at a certain distance from the first, blind end of the near wall cooling duct 220.

It will be appreciated, that the flow of coolant, before it is discharged through coolant discharge duct 210, serves to cool an extended area of the wall 100. In particular, cooling is applied to surface areas of coolant ducts which are disposed towards the hot gas side surface 110, and thus to sections of the wall 100 which are exposed to a major heat intake from the working fluid flow 50. It will further be appreciated that the cooling becomes effective over a considerable longitudinal extent of the wall along the main working fluid flow direction. As can further be seen in FIG. 1, a further coolant inflow duct and near wall cooling duct may be provided adjacent the coolant discharge duct 210, and upstream thereof, with respect to the main working fluid flow direction, and may in a manner not shown in the present depiction, but which is apparent to the skilled person, be in fluid communication with a further coolant discharge duct. Thus, essentially the entire extent of the wall 100 may be provided with cooling features, and a more homogeneous temperature distribution within the wall 100 may be achieved. Moreover, effective cooling of a portion of the wall 100 bearing the first section of the coolant discharge duct delimiting surface and where a low material thickness is provided, is effected due to impingement cooling of said coolant discharge duct delimiting surface section.

Figure 2:
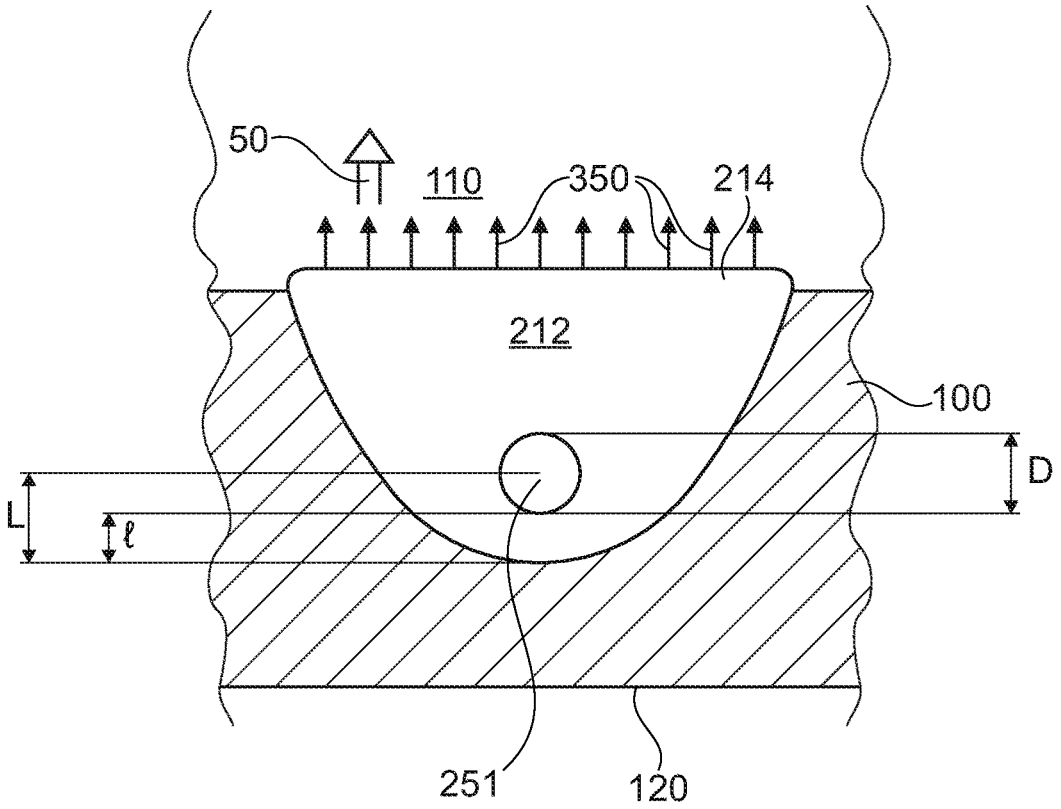
FIG. 2 a sectional view of a wall of a turbo-engine component exposing a first exemplary embodiment of a coolant discharge duct in a further longitudinal section.

FIG. 2 shows a sectional view along A-A in FIG. 1 in a first embodiment. While it is visible in connection with FIG. 1 that the fluid discharge duct 210 converges when considering an orientation of the coolant discharge duct from within the wall towards the discharge opening 214 provided on the hot gas side surface 110 of the wall 100 in a longitudinal section of the wall, in this cross-sectional aspect the coolant discharge duct diverges when considering the same orientation. A coolant discharge opening 214 assumes the shape of a slot, with the longitudinal orientation of the slot extending across the direction of the working fluid flow 50. Coolant discharge flow 350 thus is provided as a layer of coolant extending across the main working fluid flow direction. The coolant supply path joins the coolant discharge duct through coolant supply opening 251 provided on the second delimiting surface section 212 of the coolant discharge duct. Coolant discharge opening 251 has a size D in the coolant flow direction, or, in this specific instance, a diameter D. A lower or upstream edge is spaced from the blind or upstream end of the coolant discharge duct by a distance I, which is in certain embodiments larger than or equal to 50% of the size D, and in still further embodiments larger than or equal to 70% of the size D. In another aspect, a center of the coolant supply opening 251, when seen along the coolant flow direction, is spaced apart from the blind or upstream end of the coolant discharge duct by a distance L which is larger than or equal to D, and is more particularly larger than or equal to 1.2 D.

Figure 3:
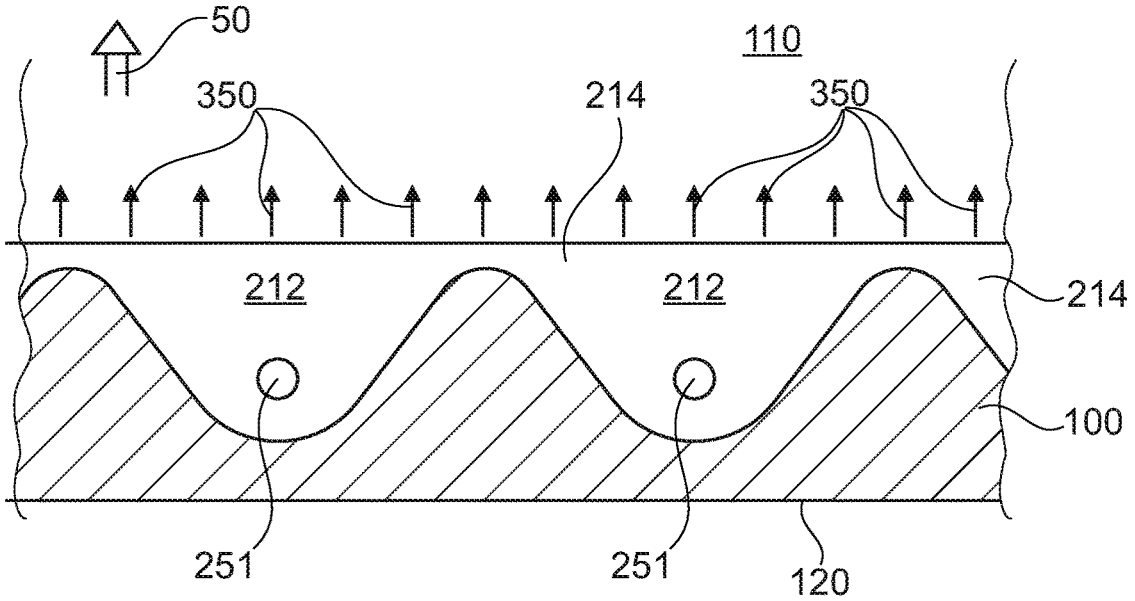
FIG. 3 a cross sectional view of a wall of a turbo-engine component exposing a further exemplary embodiment of coolant discharge ducts in a longitudinal section similar to that of FIG. 2.

FIG. 3 shows a sectional view along A-A in FIG. 1 in a second embodiment. Again, a cross-sectional view of the component, or the wall 100, respectively, is shown, providing a plan view on second sections 212 of surfaces which delimit coolant discharge ducts. Individual coolant discharge ducts are arranged adjacent each other in a direction across the main working fluid flow direction 50. The individual coolant discharge ducts are shaped in this cross-sectional view, and are arranged, such that they join each other at the hot gas side surface 110 of the wall 100. One common coolant discharge slot 214 is provided on the hot gas side surface 110 for the coolant discharge ducts arranged in one cross-section of the wall. Thus, a largely homogeneous layer of discharged coolant 350 is provided on the hot gas side surface 110. Coolant is supplied to the coolant discharge ducts through individual coolant supply openings 251 in the second section of the delimiting surface of a respective coolant discharge duct. As lined out in connection with FIG. 1, a nozzle is provided in the coolant supply path upstream the coolant supply openings 251, wherein upstream in this instance relates to the direction of the coolant supply flow, such as to accelerate the coolant supply flow before it enters a coolant discharge duct, and to discharge the coolant supply flow as a free jet into the coolant discharge ducts. As lined out in connection with FIG. 1, the free jets discharged from coolant supply openings 251 are provided for impingement cooling of a first section of a delimiting surface of a coolant discharge duct which is arranged opposite surface section 212, and which delimits the coolant discharge duct towards the hot gas side surface of the wall. While said first delimiting surface section is not visible in the present cross-sectional view, it has been lined out in detail in connection with FIG. 1.

Figure 4:
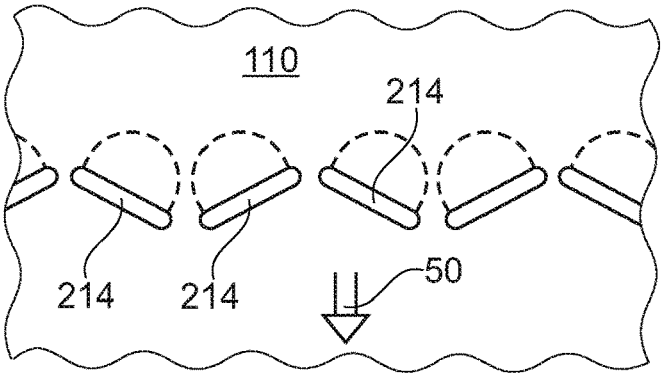
FIG. 4 a view onto a hot gas side surface of a component wall with a first arrangement of coolant discharge ducts and coolant discharge openings.

FIG. 4 depicts the plan view onto the hot gas side surface 110 of an exemplary embodiment of a turbo-engine component as herein described. Across the main working fluid flow direction 50 a multitude of slot-shaped coolant discharge openings 214 is arranged along a zig-zag line. The coolant discharge openings are arranged with short edges of two neighboring coolant discharge slots being disposed adjacent each other. The coolant discharge ducts which are provided inside the wall are indicated by dashed lines.

Figure 5:
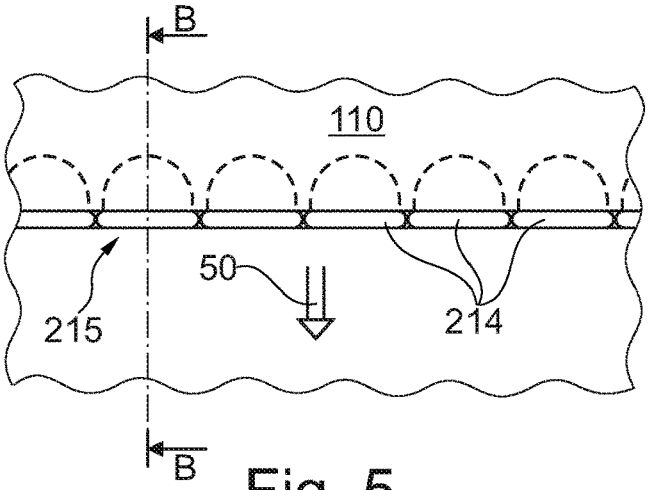
FIG. 5 a view onto a hot gas side surface of a component wall with a second arrangement of coolant discharge ducts and coolant discharge openings similar to those shown in FIG. 3.
Figure 6:
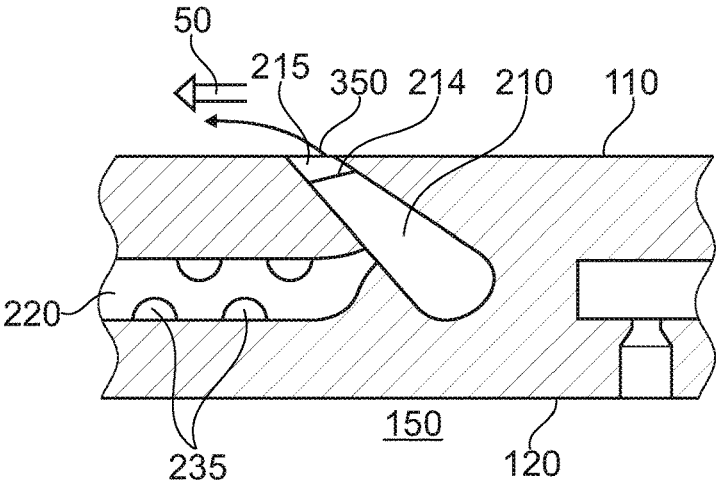
FIG. 6 a sectional view of the embodiment of FIG. 5.

FIG. 5 depicts a plan view onto the hot gas side surface 110 of a further exemplary embodiment of a turbo-engine component as herein described, and already mentioned in connection with FIG. 3. Across the main working fluid flow direction 50 a multitude of coolant discharge ducts, indicated by dashed lines, are arranged. The coolant discharge ducts terminate towards the hot gas side surface 110 in slot-shaped coolant discharge openings 214. A long extent of the slots is provided across the main working fluid flow direction. The coolant discharge openings 214 of the individual coolant discharge ducts adjoin each other at short edges thereof, and thus form a common coolant discharge opening 215 on the hot gas side surface 110. The sectional view indicated at B-B in FIG. 5 is shown in FIG. 6. Most of the elements shown in FIG. 6 have been lined out in detail above, and additional explanations in connection with FIG. 6 are thus omitted. Coolant discharge duct 210 terminates at coolant discharge opening 214 thereof below the hot gas side surface 110, and joins the common coolant discharge duct 215.

Figure 7:
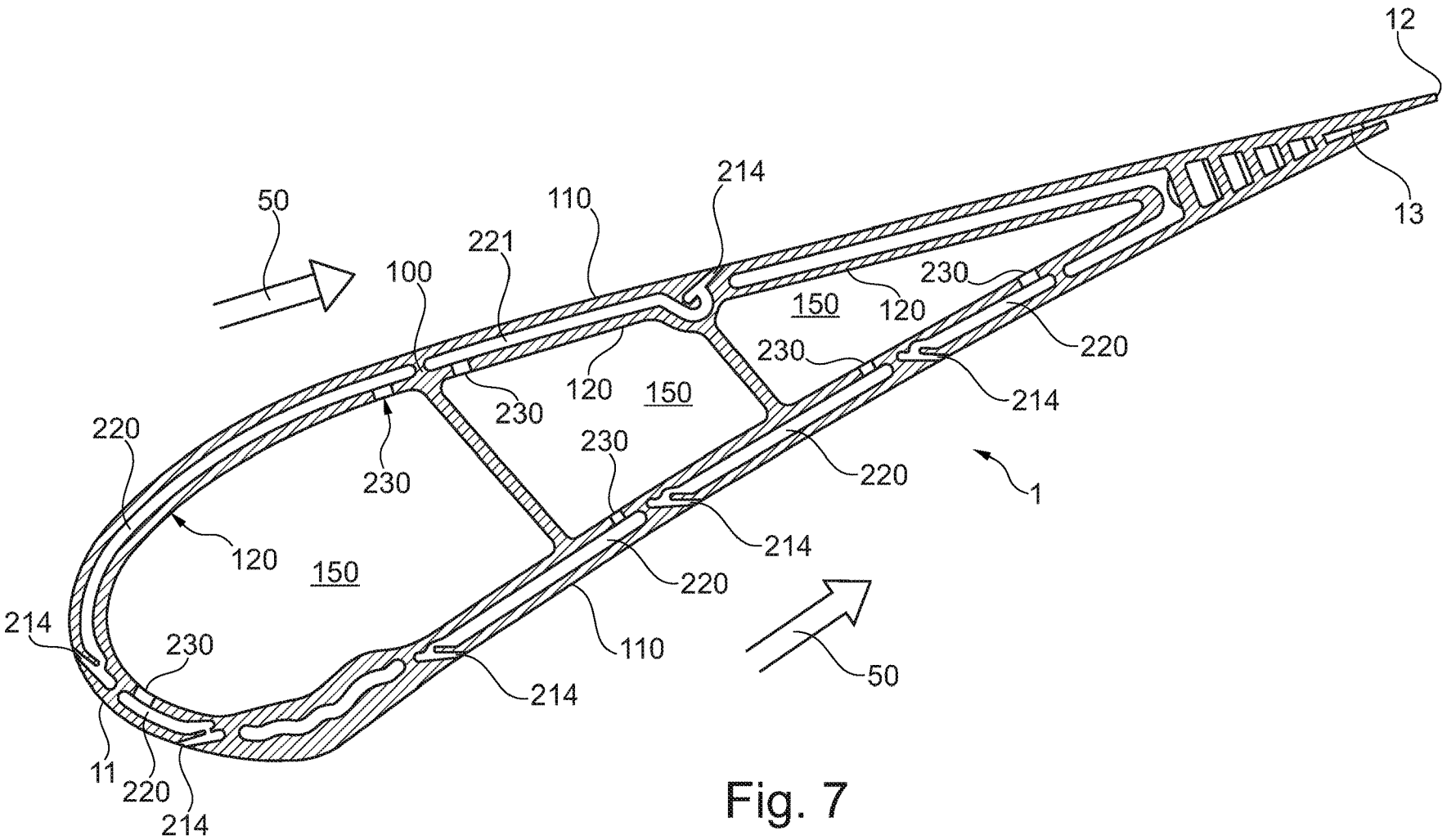
FIG. 7 an exemplary embodiment of a turbo-engine component according to the present disclosure.

An exemplary embodiment of a turbine airfoil 1 is shown in FIG. 7, as an embodiment of a turbo-engine component according to the present disclosure. The airfoil 1 comprises a leading edge 11 and a trailing edge 12. A suction side and a pressure side are arranged between the leading edge and the trailing edge. A working fluid flow 50 flows around the airfoil, from the leading edge to the trailing edge, and along the pressure side and the section side. A trailing edge coolant slot 13 is provided at the trailing edge in a known manner. A wall 100 of the airfoil encloses coolant supply volumes 150 provided inside the airfoil, and being delimited by coolant side surfaces 120 of the wall 100. A hot gas side surface 110 of the wall is exposed to the working fluid flow 50. The wall 100 is equipped with a multitude of coolant discharge ducts (without reference numbers in this figure) which open out onto the hot gas side surface at coolant discharge openings 214. Each coolant discharge duct is in fluid communication with either a counterflow near wall cooling channel 220, or a parallel flow near wall cooling duct 221. Each near wall cooling duct is in fluid communication with a coolant supply volume 150 through a coolant inflow duct 230.

While the subject matter of the disclosure has been explained by means of exemplary embodiments, it is understood that these are in no way intended to limit the scope of the claimed invention. It will be appreciated that the claims cover embodiments not explicitly shown or disclosed herein, and embodiments deviating from those disclosed in the exemplary modes of carrying out the teaching of the present disclosure will still be covered by the claims.

LIST OF REFERENCE NUMERALS

| | |
|---|---|
| 1 | turbo-engine component, airfoil |
| 11 | leading edge |
| 12 | trailing edge |
| 13 | trailing edge cooling slot |
| 50 | working fluid flow; main working fluid flow direction |
| 100 | wall of turbo-engine component |
| 110 | hot gas side surface |
| 111 | normal of the hot gas side surface |
| 120 | coolant side surface |
| 150 | coolant supply volume |
| 210 | coolant discharge duct |

-continued

LIST OF REFERENCE NUMERALS

| | |
|---|---|
| 211 | first section of a delimiting surface delimiting the coolant discharge duct |
| 212 | second section of a surface delimiting the coolant discharge duct |
| 213 | axis of the coolant discharge duct |
| 214 | coolant discharge opening, coolant discharge slot |
| 215 | common coolant discharge opening, |
| 220 | near wall cooling duct |
| 221 | parallel flow near wall cooling duct |
| 225 | protruding elements, turbulators, turbulence generating elements |
| 230 | coolant inflow duct |
| 240 | nozzle |
| 250 | nozzle, free jet generating means, flow accelerating means |
| 251 | coolant supply opening |
| 310 | coolant supply flow |
| 320 | coolant free jet |
| 330 | near wall coolant flow |
| 340 | coolant free jet |
| 350 | coolant discharge flow |
| $\alpha$ | angle |
| D | size of the coolant supply opening and/or free jet generating means along the coolant flow direction inside the coolant discharge duct; diameter of the coolant supply opening and/or free jet generating means |
| I | distance from a blind end of the coolant discharge duct to a downstream edge of the coolant supply opening and/or free jet generating means |
| L | distance from a blind end of the coolant discharge duct to a center of the coolant supply opening and/or free jet generating means |

The invention claimed is:

1. A turbo-engine component comprising:

a wall, the wall having a hot gas side surface and a coolant side surface, wherein a plurality of coolant discharge ducts is provided in said wall, the plurality of coolant discharge ducts comprising a first coolant discharge duct, wherein each of the coolant discharge ducts opens out onto the hot gas side surface at a respective coolant discharge opening of a plurality of coolant discharge openings, each of the coolant discharge openings having a slotted shape, a coolant flow direction being defined from an interior of each coolant discharge duct towards the respective discharge opening, each coolant discharge duct further being delimited by a delimiting surface thereof provided inside the wall, each coolant discharge duct having a first cross sectional direction and a second cross sectional direction, wherein each coolant discharge duct is a blind cavity and is closed towards the coolant side surface, and further a dimension of each coolant discharge duct measured in the respective first cross sectional direction decreases in the coolant flow direction, and wherein the coolant discharge openings are arranged in a zig-zag pattern on the hot gas side surface.

2. The turbo-engine component according to claim 1, wherein a dimension of the first coolant discharge duct measured in the second cross sectional direction increases in the coolant flow direction.

3. The turbo-engine component according to claim 1, wherein a flow cross section provided by the first coolant discharge duct decreases in the coolant flow direction.

4. The turbo-engine component according to claim 1, wherein a longitudinal extent of the slotted shape of the coolant discharge opening of the first coolant discharge duct is provided along the second cross sectional direction.

5. The turbo-engine component according to claim 1, wherein the first coolant discharge duct is inclined with respect to a normal of the hot gas side surface at a first angle, wherein the inclination is provided in a plane defined by the first cross sectional direction and said normal, such that a lateral delimiting surface of the first coolant discharge duct comprises:

a first surface section disposed towards the hot gas side surface of the wall and a second surface section disposed towards the coolant side surface of the wall.

6. The turbo-engine component according to claim 1, wherein the first coolant discharge duct is inclined with respect to a normal of the hot gas side surface at a first angle, wherein said inclination is directed downstream a main working fluid flow direction of the component when seen in a coolant flow direction.

7. The turbo-engine component according to claim 1, wherein the delimiting surface of the first coolant discharge duct comprises:

a first surface section disposed towards the hot gas side surface and a second surface section disposed towards the coolant side surface, wherein at least one of the first and second surface sections includes a flat surface section.

8. The turbo-engine component according to claim 1, comprising:

a coolant supply path provided in the wall and in fluid communication with the first coolant discharge duct, wherein the coolant supply path joins the first coolant discharge duct at a lateral delimiting surface thereof at a nonzero angle.

9. The turbo-engine component according to claim 8 wherein the coolant supply path comprises:

a means for providing a free jet emanating from the coolant supply path and disposed at a junction between the coolant supply path and the first coolant discharge duct.

10. The turbo-engine component according to claim 1 further comprising a coolant supply path, wherein the coolant supply path joins the first coolant discharge duct through an opening provided in a lateral delimiting surface section thereof disposed towards the coolant side surface of the wall.

11. The turbo-engine component according to claim 1 further comprising a coolant supply path, wherein the coolant supply path comprises:

a plurality of near wall cooling ducts, each said near wall cooling duct running inside the wall along a lengthwise extent of the wall, each said near wall cooling duct extending from a first end to a second end, wherein the second end of a first near wall cooling duct of the plurality of near wall cooling ducts is disposed towards the first coolant discharge duct.

12. The turbo-engine component according to claim 11, comprising:

a flow accelerating means disposed adjacent the second end of the first near wall cooling duct and providing fluid communication between said second end and the first coolant discharge duct.

13. The turbo-engine component according to claim 11, further comprising:

a plurality of coolant inflow ducts, each said coolant inflow duct extending from the coolant side surface of the wall to a corresponding one of the near wall cooling ducts and, wherein a first coolant inflow duct of the plurality of coolant inflow ducts joins the first near wall cooling duct at a side wall thereof at a junction, whereas the junction is provided adjacent the first end of the first near wall cooling duct.

14. The turbo-engine component according to claim 1, wherein the coolant discharge openings are arranged such that short edges of two neighboring coolant discharge openings are disposed adjacent each other.

* * * * *